US010218103B2

(12) United States Patent
Ostermann et al.

(10) Patent No.: US 10,218,103 B2
(45) Date of Patent: Feb. 26, 2019

(54) CONTACT STUD, TERMINAL AND CONTACT ASSEMBLY IN PARTICULAR FOR CAR TECHNOLOGY

(71) Applicants: TE Connectivity Germany GmbH, Bensheim (DE); Tyco Electronics UK Ltd, Swindon (GB)

(72) Inventors: Rudiger Ostermann, Rimbach (DE); Hartmut Ripper, Darmstadt (DE); Mile Trajkov, Frankfurt (DE); John Marsh, London (GB)

(73) Assignees: TE Connectivity Germany GmbH, Bensheim (DE); Tyco Electronics UK Ltd, Swindon (GB)

( * ) Notice: Subject to any disclaimer, the term of this patent is extended or adjusted under 35 U.S.C. 154(b) by 0 days.

(21) Appl. No.: 15/440,038

(22) Filed: Feb. 23, 2017

(65) Prior Publication Data

US 2017/0244187 A1 Aug. 24, 2017

(30) Foreign Application Priority Data

Feb. 23, 2016 (EP) ..... 16156972

(51) Int. Cl.
*H01R 4/66* (2006.01)
*H01R 13/04* (2006.01)
(Continued)

(52) U.S. Cl.
CPC ..... *H01R 13/04* (2013.01); *H01R 13/03* (2013.01); *H01R 13/111* (2013.01);
(Continued)

(58) Field of Classification Search
CPC ..... H01R 13/04; H01R 13/03; H01R 13/035; H01R 24/30; H01R 24/62; H01R 13/631; H01R 13/6616; H01R 12/7076; H01R 12/721; H01R 13/111; H01R 2201/26; H01R 2101/00
USPC ..... 439/108
See application file for complete search history.

(56) References Cited

U.S. PATENT DOCUMENTS 4,747,783 A * 5/1988 Bellamy ..... H01R 13/03 200/268
4,756,695 A * 7/1988 Lane ..... H01R 24/62 439/535
(Continued)

FOREIGN PATENT DOCUMENTS

EP 0265755 A2 5/1988
JP 2006339167 A 12/2006
JP 2014154377 A 8/2014

OTHER PUBLICATIONS

European Search Report, dated Jul. 21, 2016, 8 pages.
Abstract of JP2006339167, dated Dec. 14, 2006, 2 pages.
Abstract of JP2014154377, dated Aug. 25, 2014, 1 page.

*Primary Examiner* — Jean F Duverne
(74) *Attorney, Agent, or Firm* — Barley Snyder

(57) ABSTRACT

A contact stud is disclosed. The contact stud has a protector, a connection section, and a base section. The connection section is insertable into a terminal along an insertion direction. The connection section has a contact region protected by the protector from an insulative coating applied to a remainder of the connection section. The base section is mounted on a grounding surface.

20 Claims, 8 Drawing Sheets

(51) Int. Cl.

| | |
|---|---|
| ***H01R 24/30*** | (2011.01) |
| ***H01R 13/11*** | (2006.01) |
| ***H01R 13/631*** | (2006.01) |
| ***H01R 13/03*** | (2006.01) |
| ***H01R 13/52*** | (2006.01) |
| *H01R 101/00* | (2006.01) |
| *H01R 13/187* | (2006.01) |

(52) U.S. Cl.
CPC ..... *H01R 13/5219* (2013.01); *H01R 13/631* (2013.01); *H01R 24/30* (2013.01); *H01R 13/187* (2013.01); *H01R 2101/00* (2013.01); *H01R 2201/26* (2013.01)

(56) References Cited

U.S. PATENT DOCUMENTS 4,889,495 A * 12/1989 Kimura ..... H01R 12/7076 361/679.32
4,897,055 A * 1/1990 Jurista ..... H01R 12/721 439/699.1
5,144,586 A * 9/1992 Faraci ..... G11C 5/00 365/226
5,810,627 A * 9/1998 Gierut ..... H01R 13/187 439/843
6,537,091 B2 * 3/2003 Hirai ..... H01R 13/035 439/181
6,547,608 B2 * 4/2003 Sato ..... H01R 13/11 439/851
6,659,783 B2 * 12/2003 Copper ..... H01R 13/6616 361/2
6,860,746 B2 * 3/2005 Ota ..... H01R 13/03 439/181
6,918,800 B2 * 7/2005 Ota ..... H01R 13/03 439/181
8,613,626 B1 * 12/2013 Phan ..... H01R 13/11 439/181
2011/0021049 A1 1/2011 Ramasubramanian et al.
2016/0254610 A1 * 9/2016 Hirakawa ..... H01R 13/187 439/816

* cited by examiner

CONTACT STUD, TERMINAL AND CONTACT ASSEMBLY IN PARTICULAR FOR CAR TECHNOLOGY

CROSS-REFERENCE TO RELATED APPLICATION

This application claims the benefit of the filing date under 35 U.S.C. § 119(a)-(d) of European Patent Application No. 16156972.8, filed on Feb. 23, 2016.

FIELD OF THE INVENTION

The present invention relates to a contact stud, a terminal, and a contact assembly, and more particularly, to a contact stud, a terminal, and a contact assembly used in a grounding application.

BACKGROUND

For electrical installations in a car, for example, the car body is usually used as a ground. A threaded connection is commonly used to form the connection to the ground; a threaded bolt is attached to the car body and a nut is screwed onto the bolt to protect a part of the bolt from being coated with an insulating coating like paint or lacquer in a subsequent step. Later on, the nut is removed, a grounding cable is attached and the nut is again screwed onto the bolt. This known procedure, however, is time-consuming.

SUMMARY

An object of the invention, among others, is to provide a contact stud with a more efficient ground connection. The disclosed contact stud has a protector, a connection section, and a base section. The connection section is insertable into a terminal along an insertion direction. The connection section has a contact region protected by the protector from an insulative coating applied to a remainder of the connection section. The base section is mounted on a grounding surface.

BRIEF DESCRIPTION OF THE DRAWINGS

The invention will now be described by way of example with reference to the accompanying Figures, of which.

DETAILED DESCRIPTION OF THE EMBODIMENT(S)

Figure 2:
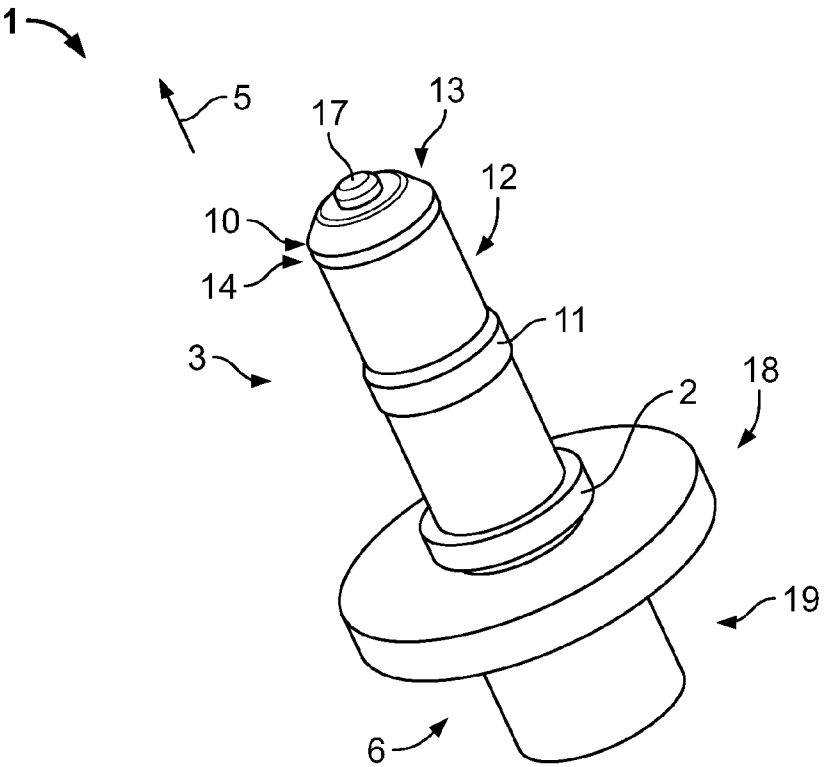
FIG. 2 is a perspective view of the contact stud of FIG. 1.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

A contact stud 1 according to the invention is shown in FIGS. 1, 2, 13A, and 13B. The contact stud 1 is used to provide a ground connection to a grounding surface C. The grounding surface C may be, for example, a car body. In other embodiments, the contact stud 1 can provide a power connection or a signal connection. The grounding surface C is attached to a base section 6 of the contact stud 1. To this end, the contact stud 1 has a deformation section 19 that can be deformed in a rivet-like manner. Alternatively to the mounting by deformation, the contact stud 1 could be welded to the grounding surface C. A flange 18 maintains the contact stud 1 in an upright position 90° perpendicular to a metal sheet of the grounding surface C.

Figure 1:
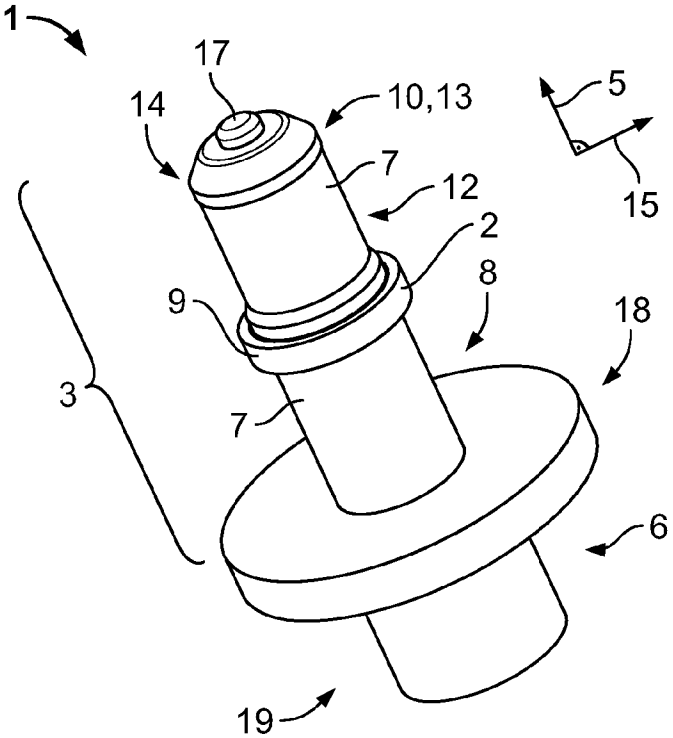
FIG. 1 is a perspective view of a contact stud according to the invention.

The contact stud 1, as shown in FIGS. 1 and 2, also has a connection section 3 that is adapted to be inserted into a ground terminal 20 along an insertion direction 5. In an initial position shown in FIG. 1, a contact region 11 of the connection section 3 is covered by a protector 2 and is protected from being coated by a coating. Once the contact stud 1 is attached to the grounding surface C, the entire grounding surface C including the contact stud 1 is coated with a coating 7. The protector 2, however, protects the contact region 11 from being coated so that at a later stage, shown for example in FIG. 2, when the protector 2 is shifted away from the initial position, an electrical contacting is possible at the contact region 11. The protector 2 is shiftable along the insertion direction 5 and is automatically shifted away from the contact region 11 when the contact stud 1 is inserted into the terminal 20. The details of this process are described below. Outside the contact region 11, the contact stud 1 is coated with the insulating coating 7.

The contact region 11 is located on a part 8 of the contact stud 1 that has a constant cross-section along the insertion direction 5. In the embodiment shown in FIGS. 1 and 2, the protector 2 is a ring 9 that is adapted to the cross section of the part 8. The ring 9 can be moved and shifted without undue force. Further, the ring 9 does not damage the coating 7 on the part 8.

Figure 8:
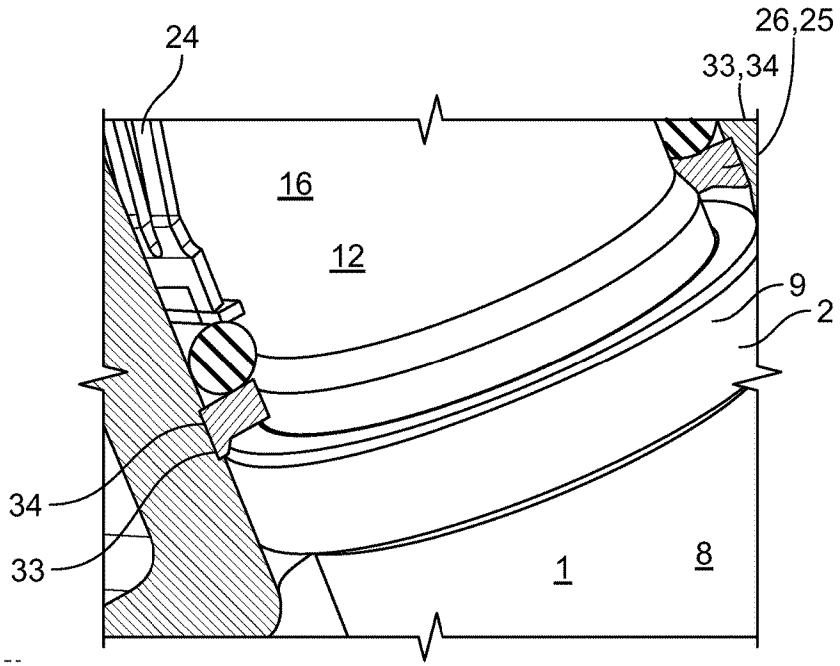
FIG. 8 is a detail view of a part of FIG. 7.
Figure 7:
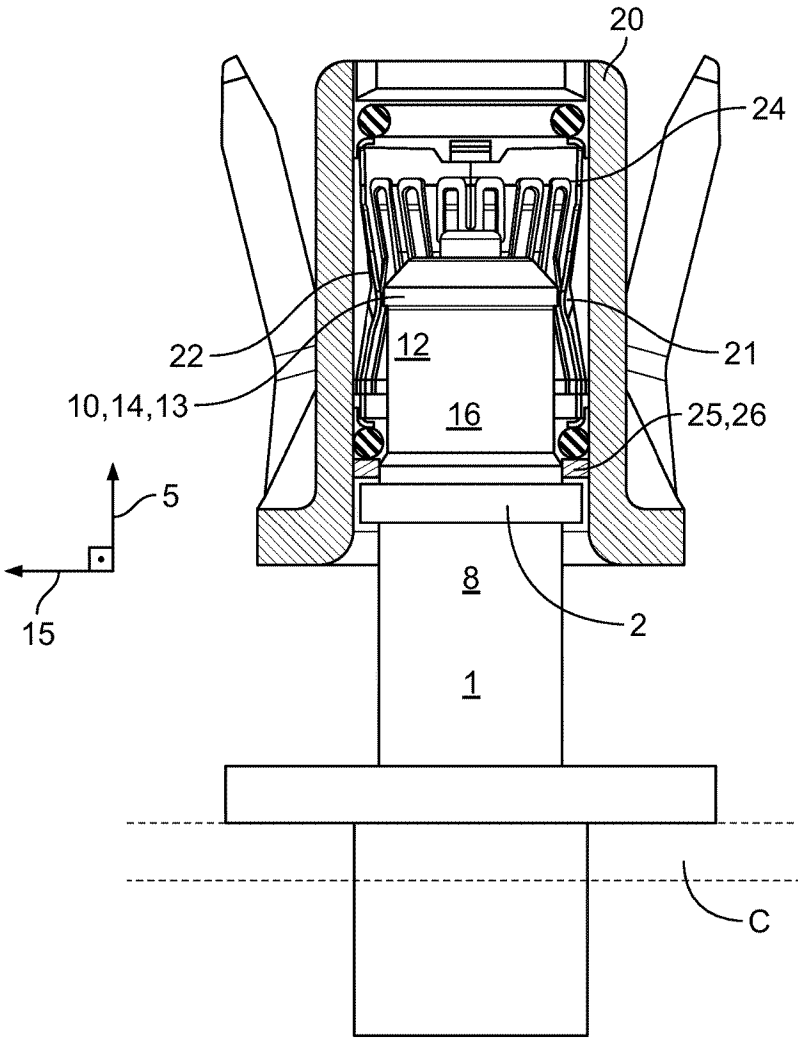
FIG. 7 is a sectional front view of the contact stud and the terminal in a partially inserted position.

The contact stud 1 has an intermediate section 12 disposed adjacent the contact region 11. In the shown embodiment, the intermediate section 12 is a channel 16, as shown in FIGS. 7 and 8. The contact stud 1 further comprises a contact projection 10 disposed adjacent the intermediate section 12 that serves to latch the contact stud 1 in the terminal 20 in a fully mated position F, the details of which are described below. In the shown embodiment, the contact projection 10 is a rim 14. A detection projection 17 protrudes in an insertion direction 5 from a front part of the contact stud 1.

The contact stud 1 is rotationally symmetric around an axis that is parallel to the insertion direction 5. Due to this, the mounting can be simplified as the rotational position of the contact stud 1 does not matter. Further, the contact stud 1 can rotate in the terminal 20 once it is assembled.

The terminal 20 is shown in FIGS. 3, 4, 12A, and 12B. The terminal 20 has a crimping section 29 that is adapted to be crimped to a ground cable. In other embodiments, the cable may be welded or soldered to the terminal 20. The terminal 20 has a receptacle 22 receiving the contact stud 1. The receptacle 22 has an opening 31 through which the contact stud 1 enters the terminal 20. A contact spring 24 is disposed in the receptacle 22 and has several contact surfaces 21 protruding inwardly into the receptacle 22 for making an electrical connection to the contact region 11 of the contact stud 1. The contact surfaces 21 are located cylindrically around an axis parallel to the insertion direction 5 so that the rotational mounting position can be arbitrary and that a rotation of the terminal 20 to the contact stud 1 is possible. The receptacle 22 is generally cylindrical at the inside and the outside.

Figure 4:
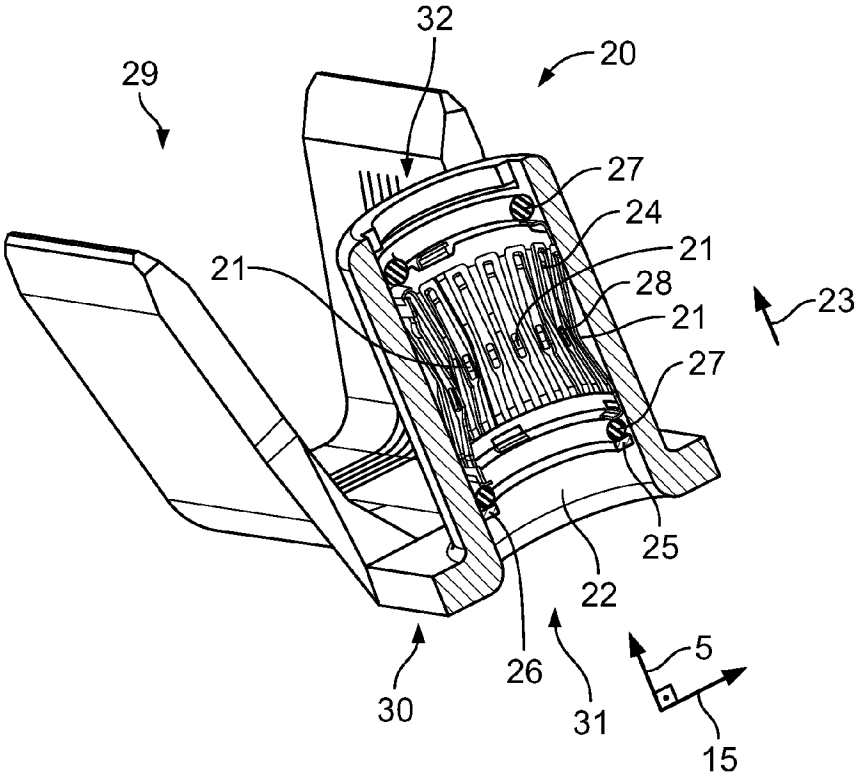
FIG. 4 is a sectional perspective view of the terminal of FIG. 3.
Figure 3:
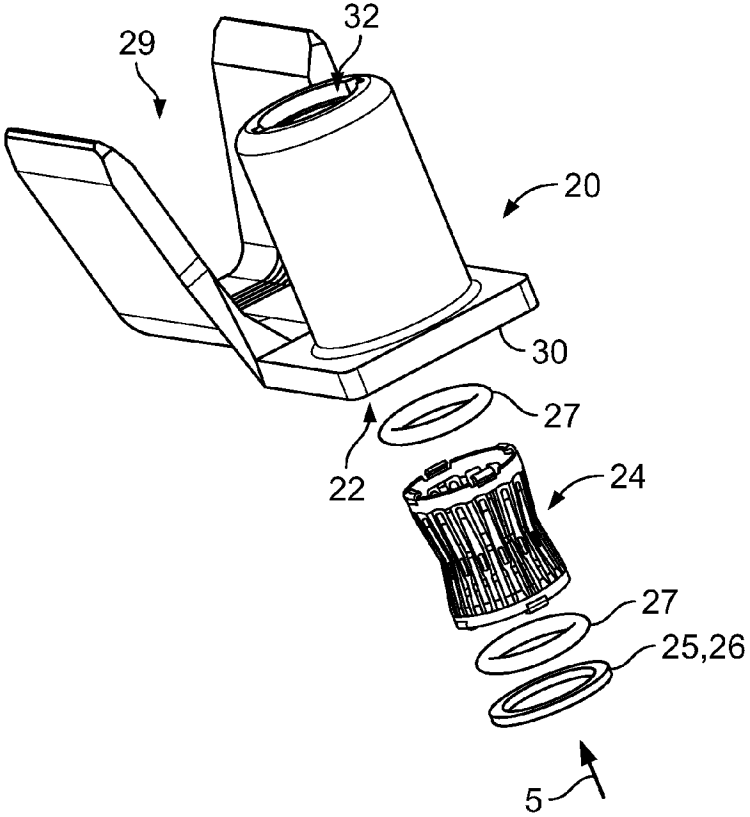
FIG. 3 is an exploded perspective view of a terminal according to the invention.

A terminal projection 25 in the form of a metal ring 26, as shown in FIGS. 3 and 4, projects into the receptacle 22. The terminal projection 25 shifts the protector 2 of the contact stud 1 away from the contact region 11. The terminal projection 25 is located in a channel 33 or a recess 34 in an inner wall of the receptacle 22, as shown in FIG. 8.

The terminal 20 has a flange 30 that protrudes perpendicular to the insertion direction 5 and ensures a stable mounting. The terminal 20 also has a pair of seals 27 in the form of elastic sealing rings that seal the contact space 28 once the contact stud 1 is fully mounted to the terminal 20. A second opening 32 that is located opposite the first opening 31 is used to inspect the position of the contact stud 1 in the terminal 20. For example, a sensor could be used for detecting the correct positioning.

Figure 6:
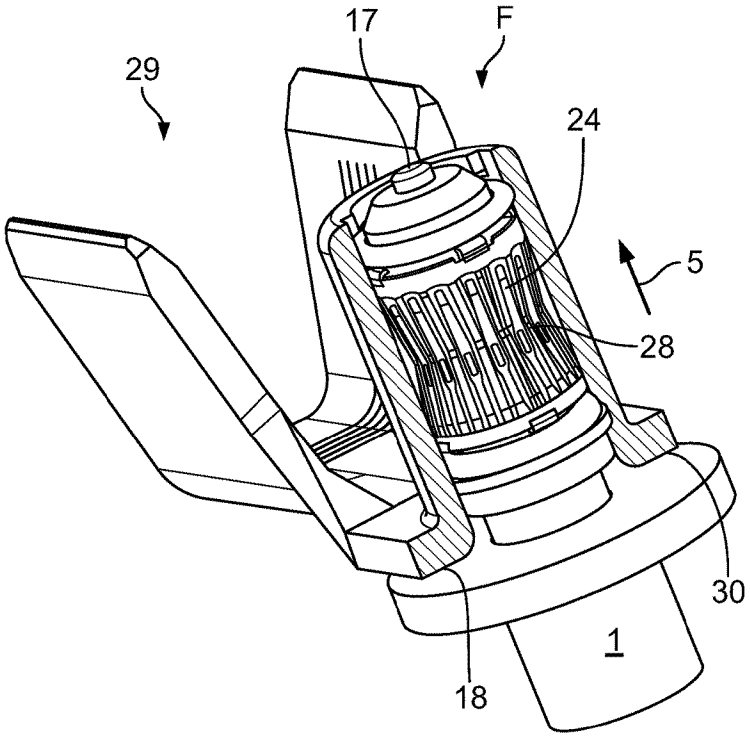
FIG. 6 is a sectional perspective view of the contact stud of FIG. 1 and the terminal of FIG. 3 in a fully mated position.
Figure 5:
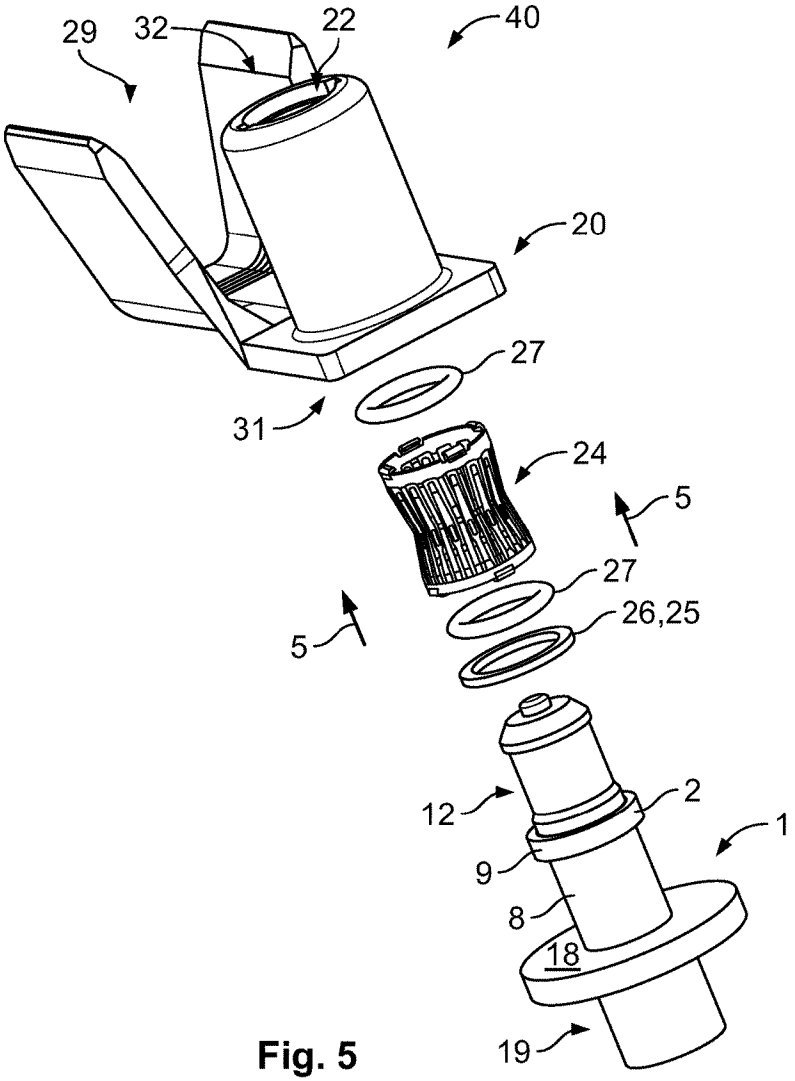
FIG. 5 is an exploded perspective view of the contact stud of FIG. 1 and the terminal of FIG. 3.

The contact stud 1 and terminal 20 are shown together in FIGS. 5 and 6. In FIG. 6, the contact stud 1 and the terminal 20 are in a fully mated position F. An electrical contact between the contact stud 1 and the terminal 20 is achieved via the contact spring 24 which contacts the contact region 11 of the contact stud 1 via the contact surfaces 21. The flanges 18 and 30 of the contact stud 1 and the terminal 20 abut each other and thereby provide a secure mechanical position.

The mounting of the contact stud 1 into the terminal 20 is shown in FIGS. 7-11.

A partially inserted position of the contact stud 1 into the receptacle 22 is shown in FIGS. 7 and 8. The contact projection 10 is in mechanical contact with the contact surfaces 21. However, no electrical connection between the two exists, as the contact projection 10 is coated with an insulating coating 7 like a paint or a lacquer that was applied on the grounding surface C and the attached contact stud 1. In FIG. 7, the position of the grounding surface C is shown.

In the partially inserted position of FIGS. 7 and 8, the protector 2 is still located over the contact region 11. Because the contact projection 10 does not protrude further in a direction 15 perpendicular to the insertion direction 5 from the rest of the contact stud 1 than the part 8 on which the contact region 11 is located, the insertion of the contact stud 1 to the contact spring 21 can be done with little effort and without damaging the contact spring 21. The channel 16 allows the contact projection 10 to protrude equally as far as the part 8 in the direction 15 perpendicular to the insertion direction 5.

Figure 10:
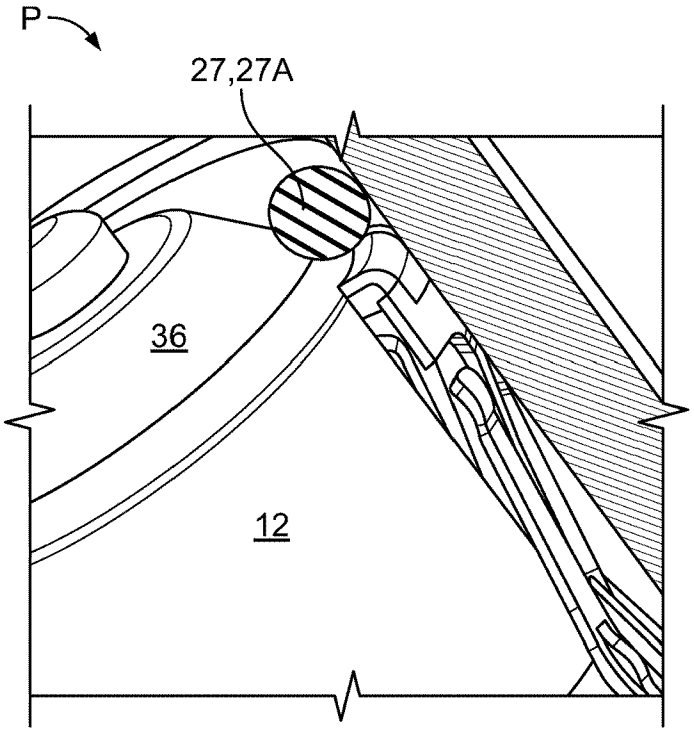
FIG. 10 is a detail view of a part of FIG. 9.
Figure 9:
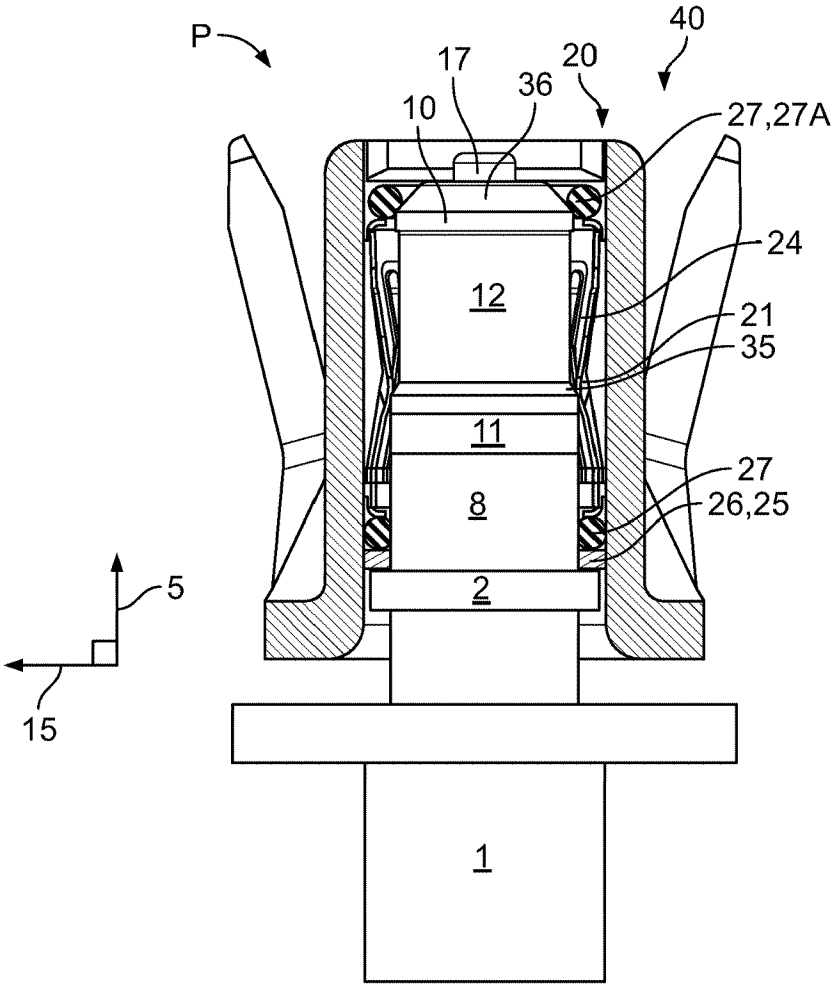
FIG. 9 is a sectional front view of the contact stud and the terminal in a pre-locking position.

In FIGS. 9 and 10, the contact stud 1 is inserted further into the terminal 20 into a pre-locking position P. The protector 2 has been shifted opposite to the insertion direction 5 from its initial position above the contact region 11 to a position further downwards by the terminal projection 25 which is in direct contact with the protector 2. An upper seal 27A has not yet been moved over the contact projection 10 and is located at a positioning section 36 that is partially conical and serves to position the contact stud 1 in the terminal 20 during the insertion process. The terminal 20 is only loosely connected to the contact stud 1 in the pre-locking position P. The contact surfaces 21 are located at a transition section 35 located between the part 8 and the intermediate section 12. The transition section 35 is partially conical.

Figure 11:
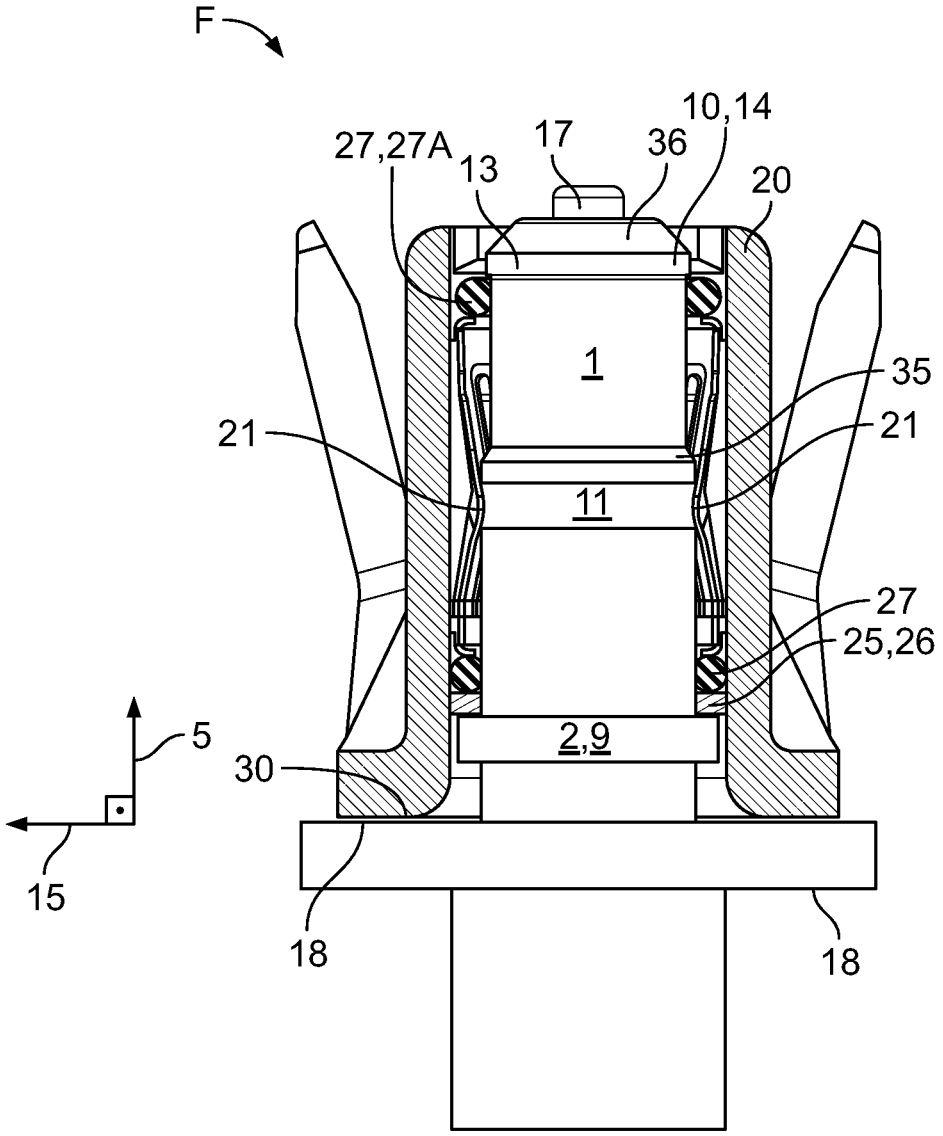
FIG. 11 is a sectional front view of the contact stud of FIG. 1 and the terminal of FIG. 3 in a fully mated position.
Figure 12B:
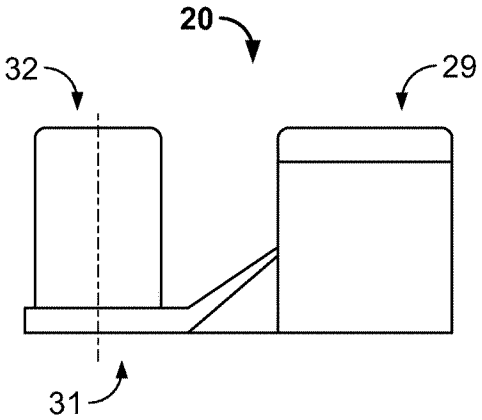
FIG. 12B is a side view of the terminal of FIG. 3.
Figure 12A:
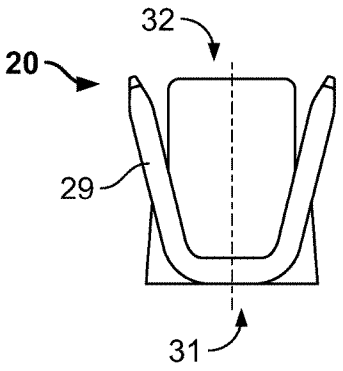
FIG. 12A is a rear view of the terminal of FIG. 3.
Figure 13B:
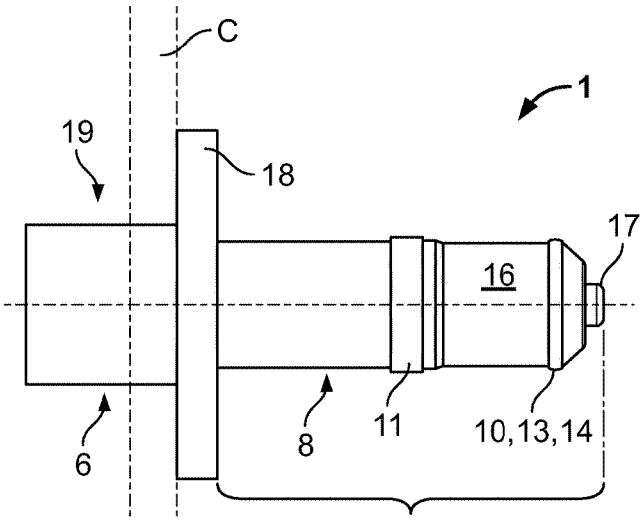
FIG. 13B is a side view of the contact stud of FIG. 1.
Figure 13A:
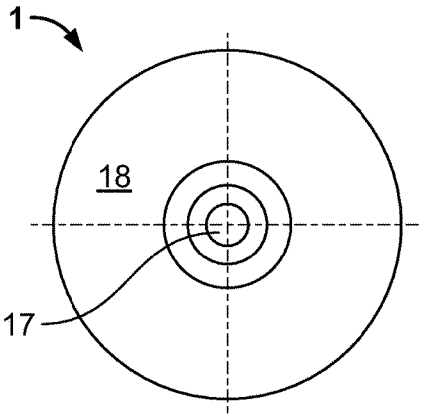
FIG. 13A is a plan view of the contact stud of FIG. 1.

In order to move the terminal 20 and the contact stud 1 into the fully mated position F of FIG. 11, it is necessary to apply a force and to compress a locking member formed by the upper seal 27A. The upper seal 27A has to be pushed over the contact projection 10.

The fully mated position F of the terminal 20 and the contact stud 1 is shown in FIG. 11. The upper seal 27A is a locking member locking the terminal 20 to the contact stud 1. The upper seal 27A is located behind the contact projection 10 that is embodied as the rim 14 in the fully mated position F. The contact projection 10 thus serves as a latch 13 for fixing the contact stud 1 relative to the contact terminal 20 due to a positive fit connection of the terminal 22 and the contact stud 1 via the locking member or upper seal 27A. In order to move the terminal 20 and the contact stud 1 out of the fully mated position F, it is necessary to apply a force for deforming the upper seal 27A.

The contact region 11 of the contact stud 1 and the contact surface 21 of the terminal 20 are at the same height along the insertion direction 5 or a height direction 23 parallel to the insertion direction in the fully mated position F. The contact region 11 of the contact stud 1 is in electrical contact with the contact surface 21 of the terminal 20. A grounding of the cable attached to the terminal 20 to the grounding surface C is established via the contact region 11 and the contact surfaces 21.

The protector 2 in the form of the ring 9 is located at its final position. In this final position, it can also serve as a positioning element for positioning, in particular for centering, the contact 1 relative to the terminal 20. The pair of seals 27 seal a contact space 28 in which the contact surfaces 21 and the contact region 11 are located. The detection projection 17 protrudes out of the terminal 20 and can be used for detecting the correct positioning of the contact stud 1 in the terminal 20. The contact stud 1 and the terminal 20 are rotatable to each other around a rotation axis that is parallel to the insertion direction 5 in the fully mated position F.

Figure 14:
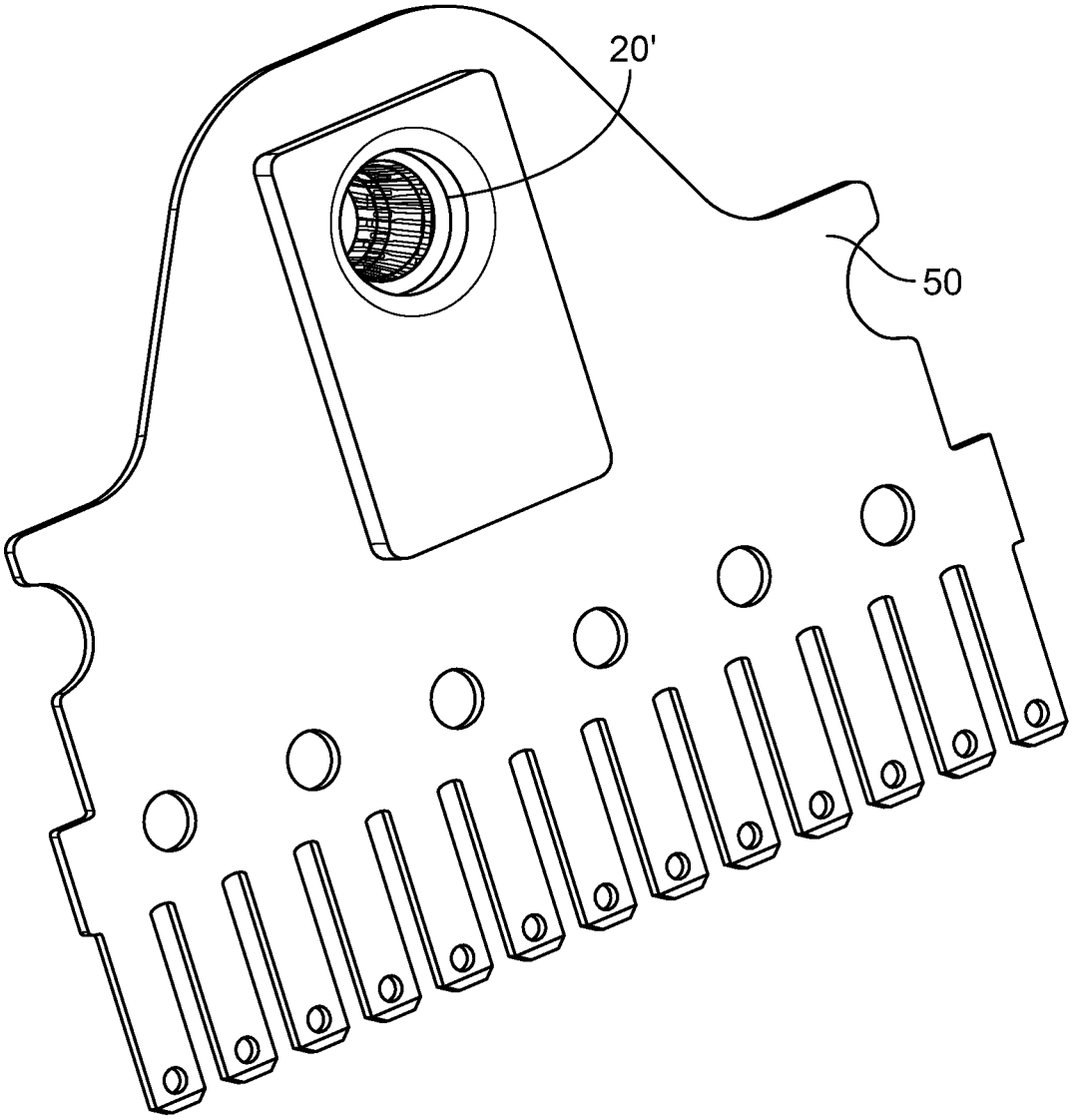
FIG. 14 is a perspective view of a terminal according to another embodiment of the invention.

A terminal 20' according to another embodiment of the invention is shown in FIG. 14. The terminal 20' is attached to a joint connector 50 which may be connected to a plurality of small wires. The contact stud 1 can be used with the terminal 20' and may have a standardized shape that can be used with a variety of different terminals 20, 20'.

Advantageously, in the contact stud 1 according to the invention, once the coating 7 is applied, the contact region 11 can be made accessible so that the contact surface 21 of the terminal 20 can access an uncoated and thus electrically conductive region. Further, by not using a threaded connection, the contact stud 1 and terminal 20 of the present invention avoid loss of electrical connection due to damage of the threads. Additionally, the ring 9 does not get lost when it is shifted away from the initial position.

What is claimed is:

1. A contact stud, comprising:

a protector;

a connection section insertable into a terminal along an insertion direction, the connection section having a contact region protected by the protector from an insulative coating applied to a remainder of the connection section, the protector is movable with respect to the contact region along the insertion direction; and a base section mounted on a grounding surface.

2. The contact stud of claim 1, wherein the contact region is disposed on a part of the contact stud having a constant cross-section along the insertion direction.

3. The contact stud of claim 2, wherein the protector is a ring adapted to the cross-section of the part.

4. The contact stud of claim 3, wherein the ring is movable along the part.

5. The contact stud of claim 1, further comprising a contact projection extending perpendicular to the insertion direction.

6. The contact stud of claim 1, wherein the insulative coating is disposed on an exterior of the remainder of the connection section and an exterior of the protector but is not disposed on the contact region.

7. A terminal, comprising:

a receptacle having a first opening in an insertion direction receiving a contact stud and a second opening disposed opposite the first opening, a presence of the contact stud in the receptacle detected through the second opening;

a contact spring disposed in the receptacle having a contact surface protruding inwardly into the receptacle; and a terminal projection formed on an inner wall of the receptacle between the first opening and the contact spring, the terminal projection projecting into the receptacle in a direction perpendicular to the insertion direction and narrowing the receptacle.

8. The terminal of claim 7, further comprising a plurality of contact surfaces positioned cylindrically around the insertion direction.

9. The terminal of claim 7, further comprising a locking member disposed in the receptacle adjacent the second opening and locking the contact stud to the terminal in a fully mated position.

10. The terminal of claim 9, wherein the locking member is elastically deformable and is less compressed in the fully mated position than in a pre-locking position of the contact stud and the terminal.

11. A contact assembly, comprising:

a contact stud having a protector, a connection section including a contact region protected by the protector from an insulative coating applied to a remainder of the connection section, and a base section mounted on a grounding surface; and a terminal having a receptacle including a first opening in an insertion direction receiving the connection section of the contact stud, and a contact spring disposed in the receptacle including a contact surface protruding inwardly into the receptacle.

12. The contact assembly of claim 11, wherein the contact region and the contact surface are at a same height along the insertion direction in a fully mated position.

13. The contact assembly of claim 11, further comprising a locking member locking the contact stud to the terminal in a fully mated position.

14. The contact assembly of claim 13, wherein the locking member is elastically deformable.

15. The contact assembly of claim 14, wherein the locking member is less compressed in a fully mated position than in a pre-locking position of the contact stud and the terminal.

16. The contact assembly of claim 15, wherein the locking member is a sealing ring of the terminal.

17. The contact assembly of claim 11, wherein the contact stud and the terminal are rotatable with respect to each other in a fully mated position.

18. A contact stud, comprising:

a protector;

a connection section insertable into a terminal along an insertion direction, the connection section having a contact region protected by the protector from an insulative coating applied to a remainder of the connection section, the contact region is disposed on a part of the contact stud having a constant cross-section along the insertion direction and the protector is a ring adapted to the cross-section of the part; and a base section mounted on a grounding surface.

19. The contact stud of claim 18, wherein the ring is movable along the part.

20. A contact stud, comprising:

a protector;

a connection section insertable into a terminal along an insertion direction, the connection section having a contact region protected by the protector from an insulative coating applied to a remainder of the connection section, the insulative coating is disposed on an exterior of the remainder of the connection section and an exterior of the protector but is not disposed on the contact region; and a base section mounted on a grounding surface.

* * * * *